United States Patent [19]

Bobik

[11] 4,377,541

[45] Mar. 22, 1983

[54] PROCESS FOR PREPARING LOW VOLTAGE VARISTORS

[75] Inventor: Carl F. Bobik, Burnt Hills, N.Y.

[73] Assignee: General Electric Company, Schenectady, N.Y.

[21] Appl. No.: 935,589

[22] Filed: Aug. 21, 1978

[51] Int. Cl.[3] ..... H01F 41/02

[52] U.S. Cl. ..... 264/56; 264/61

[58] Field of Search ..... 264/61, 56, 67, 125

[56] References Cited

U.S. PATENT DOCUMENTS

| | | | |
|---|---|---|---|
| 290,443 | 12/1883 | Magowan | 264/56 |
| 3,344,209 | 9/1967 | Hague et al. | 264/125 |
| 3,835,210 | 9/1974 | Kirkpatrick | 264/61 |

FOREIGN PATENT DOCUMENTS

| | | | |
|---|---|---|---|
| 383774 | 11/1932 | United Kingdom | 264/67 |

*Primary Examiner*—John H. Parrish

*Attorney, Agent, or Firm*—Jane Binkowski; James C. Davis, Jr.; James Magee

[57] ABSTRACT

Low voltage varistors having one or more recesses or dimples which reduces the thickness of the varistor in the recessed areas are provided by an improved process which comprises fitting a pressing surface on a die punch with a resilient material, preferably an abhesive material such as polydimethylsiloxane, having one or more nipples whereby during pressing of a metal oxide varistor powder contained in the die cavity the nipple imparts a depression thereby reducing the thickness of the varistor body in said depression. In addition, the resilient material aids in the distribution of the powder during pressing and with the preferred abhesive material aids also in the release of the pressed body from the die.

9 Claims, 7 Drawing Figures

PROCESS FOR PREPARING LOW VOLTAGE VARISTORS

BACKGROUND OF THE INVENTION

This invention relates to an improved process for preparing polycrystalline metal oxide varistors. More particularly, the invention relates to a process for preparing polycrystalline metal oxide varistors having one or more dimples which reduces the thickness of the varistor in the dimples whereby the configuration permits the breakdown voltage of the varistor to occur at a lower voltage. The term "breakdown" is not meant to denote device failure, but is used to designate a value of voltage across the device beyond which the current through the device increases greatly. That is, for voltage values below the breakdown voltage, the device behaves like an ohmic resistor of very large value (in the megohm range) but when the breakdown voltage is exceeded, the device behavior is very much like that of a low resistance conductor. These devices exhibit a very nonlinear current voltage characteristic.

Metal oxide varistors are sintered ceramics composed principally of zinc oxide with a mixture of various other metal oxides added. These other oxides are typically bismuth trioxide, cobalt trioxide, manganese dioxide, antimony trioxide, and tin dioxide, each being present to the extent of approximately ½ to 1 mole percent, the remainder of the material being zinc oxide. This powder is ground and pressed into the desired shape after which the material is sintered at a temperature of approximately 1000° C. to 1400° C. After this, electrodes are applied to faces of the material. Wires are then attached to the electrode surface for connection to external circuits.

The materials and processes for making metal oxide varistors are well known in the art and are described, for example, in U.S. Pat. No. 3,962,144, issued to Matsuura et al.

SUMMARY OF THE INVENTION

As disclosed and claimed in copending application Ser. No. 840,262, filed Oct. 7, 1977 now U.S. Pat. No. 4,364,021 in the name of Lionel M. Levinson for Low Voltage Varistor Configuration and assigned to the assignee hereof, a varistor in the form of a disc, cylinder or slug is provided with recesses, dimples or a honeycomb structure so that structural strength and reduced effective thickness are combined to new and important advantage. I have found, however, that such devices can be produced to best advantage through the use of dies having at least one punch surface fitted with a resilient material having as part thereof a protrusion, or nipple, or a plurality of such protrusions, which during pressing impart depressions to the compacted metal oxide powder thereby reducing the thickness of the resultant body in said depressions. The resilient material aids in the distribution of the powder during pressing and with the preferred materials also aids in the release and removal of the pressed body from the die.

DETAILED DESCRIPTION OF THE INVENTION

Figure 1A:
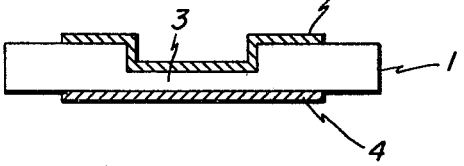
FIG. 1*a* is a cross-sectional view of a varistor made by the method of the present invention.
Figure 1B:
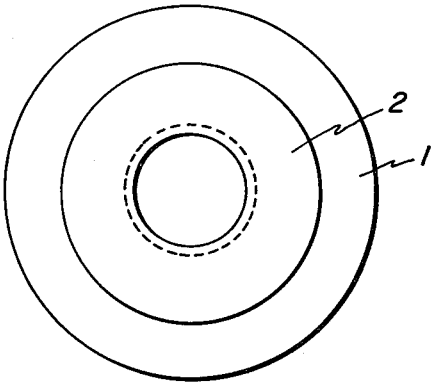
FIG. 1*b* is a plan view of the varistor of FIG. 1*a*.

Referring now to the drawings, FIGS. 1*a* and 1*b* show a varistor configuration with a single recess provided. This recess is produced in the varistor body by pressing the varistor powder into the desired shape before sintering. The present novel method for producing this recess is more particularly described below. The varistor powder mixture is typically composed principally of zinc oxide with other metal oxides added, such as the oxides of bismuth, cobalt, manganese, tin and antimony. Such compositions are well known in the varistor art.

In FIG. 1*a*, the recess shown provides an area 3, of reduced body thickness so as to produce a varistor with low breakdown voltage without sacrificing mechanical rigidity, which is provided by the surrounding varistor material. The nonrecessed or thicker areas of the device provide only for mechanical strength but do not interfere with the electrical operation, in particular the breakdown voltage. Since there is approximately a linear relation between the breakdown voltage and the device thickness, the breakdown voltage for the device is controlled by the regions of lesser thickness which are the first regions to switch into a conductive state when a voltage is applied. Substantially all of the current flows through these thinner regions thus clamping the voltage at approximately the breakdown voltage of the device rendering it impossible for the voltage across the device to increase to such a value as to cause substantial current conduction through the regions of greater thickness.

After manufacture by the novel method described hereinafter, suitable conducting electrode material 2 is applied to the recessed surface. Similar electrode conductive material 4 is applied to the opposite face of the varistor. The most common method used for such an electrode application is a coating of a silver powder mixed with finely ground glass with suitable cohesive vehicle. This composition is applied to the varistor and then fired resulting in the evaporation of the cohesive vehicle material and melting of the glass which, on cooling, results in a conductive, glass bonded silver coating. Another method of conductive electrode coating application is to apply a eutectic mixture of indium and gallium. If a metallic evaporation method is used to apply the conductive coating, aluminum, silver or gold, for example, are usable. Still another process of conductive electrode application is plasma spraying with nickel, copper or aluminum. For best results, it is desirable that the electrode material not be deposited too close to the edge of the varistor as shown in the figures. After the application of the conductive electrode material, wire leads are attached conductively to the electrodes by means such as soldering or the like.

Figure 2:
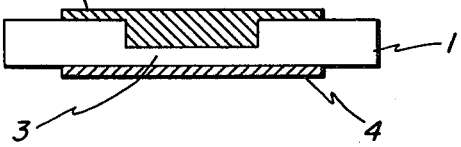
FIG. 2 is a side elevation view of a cross section through a varistor made in accordance with the present invention method with a conductive coating filling the recess.

FIG. 2 also shows a similar varistor structure except that here the conductive electrode material applied to the upper face 2 is applied in such a manner so as to completely fill the recesses rather than just to conformably coat the surfaces of the recesses. In this particular configuration, the electrode coating acts as a heat sink for thermal energy dissipation in the device. Even though the basic ingredient in the varistor material, namely, the zinc oxide, is an efficient thermal conductor, the electrically conductive material applied to the varistor surfaces is in general a better thermal conductor and in addition the recesses provide for a greater surface area for the transfer of thermal energy from the varistor body 1 to the conductive coating 2.

Figure 3:
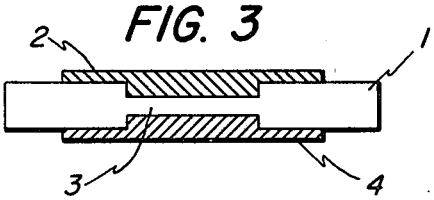
FIG. 3 is a side elevation view of a cross section through a varistor made in accordance with the present invention with a recess being present on both of the major faces of the varistor disc.

FIG. 3 shows a similar varistor structure to that shown in FIGS. 1*a* and 1*b* except that here a recess is provided on both major faces of the varistor body 1. The configuration shown in FIG. 3 exhibits a better structural integrity when the varistor bodies are handled by automated equipment. In particular, in this configuration, the fragile, narrow recessed region need not come in contact with any of the automated mechanical handling apparatus. In addition, this configuration exhibits more uniform heat dissipation.

Figure 4:
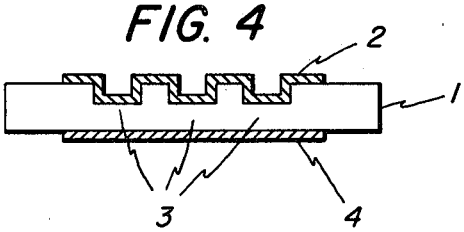
FIG. 4 is a side elevation view of a cross section through a varistor made in accordance with the present invention with a plurality of recesses being present on one of the major faces of the varistor disk.

FIG. 4 shows a varistor structure with a plurality of recesses. This configuration exhibits improved current distribution characteristics when compared to the configuration in which only a single recess is present. In this multiple recess configuration, the thicker areas of the device act as additional heat sinks for the conducting thinner regions with which the thicker regions are in intimate contact. FIG. 4 also shows conductive electrode material 2 applied to the upper recessed varistor surface and it also shows this conductive coating 4 applied to the other major varistor surface.

Figure 5:
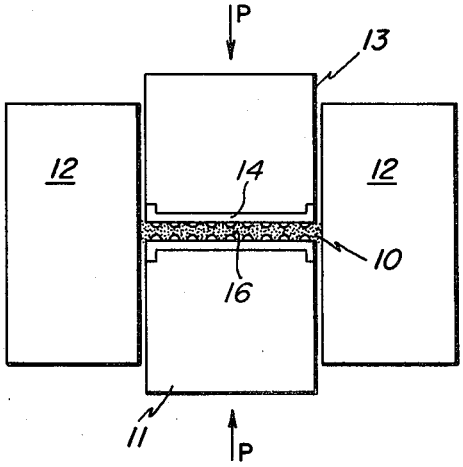
FIG. 5 is a side elevation view of the cross section of a die arrangement for pressing the varistor powder into a desired shape in accordance with one preferred embodiment for practicing the invention.
Figure 6:
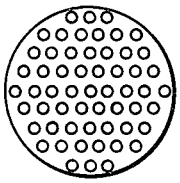
FIG. 6 is a plan view of a varistor made with the die of FIG. 5.

FIG. 5 shows a pressing die which is used for the compression of the varistor powder mix into a desired presintering shape such as shown in FIG. 6. The die comprises a lower die punch 11 and an upper die punch 13, both of which are movable in a fixed die body 12 and both of which have pressure P applied to their external faces. Between die punch 11 and die punch 13, there is placed the desired metal oxide varistor powder 10 as described above to be compacted before sintering. The end of each movable die punch 11 and 13 is fitted with a resilient nippled facing 14 which are in register with one another. The extent to which resilient nipples 16 protrude from the rest of facing 14 is sufficient, such that during the pressing operation as pressure is is applied to the distal ends of nipples 16 casing the nipples to shorten in length and broaden laterally, there is still sufficient intrusion of nipples 16 into the powder 10 to produce depressions of the proper depth. When the pressing operation is complete and the release of pressure is initiated, each nipple 16 seeks to revert to its original shape by contracting laterally and returning to its original length. The nipples are tapered so as to further provide for easy release after pressing and are preferably formed of an abhesive or non-adherent material.

The resilient material should be sufficiently rigid to form a nipple or depression in the metal oxide powder and yet deform sufficiently (as described above) to aid in leveling the powder in the die cavity during pressing. A number of materials can be employed including natural rubber, and styrene-butadiene rubber. The preferred materials, however, are abhesive or non-adherent in order to facilitate the release of the pressed body from the die. Typical abhesive materials include polyethylene, nylon, Teflon, and polydimethylsiloxane with the latter being most preferred. Suitable resilient materials can have a Shore A hardness between 10 and 90 but preferably it is between about 40 and about 60. The use of RTV resins such as a polydimethylsiloxane is preferred because they can be rapidly formed and cured. Other conventional molding means can be employed, however, to shape the resilient material for use in pressing the metal oxide powder. The thickness of the resilient material will depend upon the particular material employed and the particular die and varistor powder, but generally will be between about 1 mm and about 5 mm.

The following non-limiting examples will serve to illustrate the invention. All parts and percentages in said examples and elsewhere in the specification and claims are by weight unless otherwise specified.

EXAMPLES

One-half gram of zinc oxide varistor material and 1% by weight of aluminum stearate binder in benzene were placed in ⅝" die in which the punch surfaces were fitted with a 20 mesh nylon screen. The powder was pressed to 8 KPSI to form a disc with recessed portions on each side. The disc was also easily removed from the die because of the nonadherent or abhesive nature of the nylon.

An additional disc was formed from zinc oxide in accordance with the procedure of the previous example with the exception that no binder was employed, the pressure was increased to 15 KPSI and dimpled polymers of synthetic rubber were glued to the die punches.

A one-half gram sample of zinc oxide was placed in a ⅝" die and the opposing punches fitted with a ⅛" thick G.E. RTV 630 polysilicone facing having a plurality of 1/16" diameter nipples, 1/32" high and 3/32" between centers arranged on a hexagonal grid. The nipples were tapered to a conical angle of 6°. The zinc oxide powder was pressed at 5 KPSI and the resulting disc was easily removed from the die.

The above specimens were fired in covered containers for 1 hour at 1300° C. after heat up at 100° per hour to reach 1300° C. followed by furnace cooling after power shutdown.

After firing, a sputtered platinum electrode was applied to the discs which were ½" in diameter and appeared as shown in FIG. 6, and the disc conducted a current of 1 MA/cm$^2$ when a voltage of 125–130 volts per millimeter of thickness was impressed across it. The total area of the dimples on one side was around 0.45 cm$^2$.

What I claim as new and desire to secure by Letters Patent of the United States is:

1. In a method of forming a varistor comprising compressing a suitable powder in a die to a compact body having at least one recess, and sintering said body, the improvement comprising fitting a pressing surface in the die containing the powder with a resilient material having as part thereof at least one resilient protrusion, which during pressing imparts a depression into the surface of said powder to produce a region of reduced thickness in said compact body opposite said protrusion, said protrusion deforming during said pressing operation and returning to its undeformed shape as the compression is released.

2. The method of claim 1 in which the resilient material has a plurality of protrusions in the shape of nipples.

3. The method of claim 2 wherein the nipples are arranged substantially in a honeycomb pattern.

4. The method of claim 1 in which all of the pressing surfaces of the die are fitted with resilient material having a plurality of nipples.

5. The method of claim 4 wherein the nipples are arranged substantially in a honeycomb pattern.

6. The method of claim 1 in which the resilient material is abhesive.

7. The method of claims 1 in which the resilient material has a Shore A hardness of between about 40 and about 60.

8. The method of claims 1 in which the resilient material is a polydimethylsiloxane.

9. The method of claims 1 in which the resilient material is cured RTV resin.

* * * * *